United States Patent [19]

Janssen

[11] 4,007,560

[45] Feb. 15, 1977

[54] TWO WHEEL LAPPING MACHINE

[75] Inventor: Jos M. Janssen, Mettmann, Germany

[73] Assignee: JMJ Werkzeugmaschinen GmbH fuer Feinbearbeitung, Mettmann, Germany

[22] Filed: Aug. 18, 1975

[21] Appl. No.: 605,762

[30] Foreign Application Priority Data

Sept. 3, 1974 Germany ..... 2442081

[52] U.S. Cl. ..... 51/111 R; 51/131; 51/263

[51] Int. Cl.[2] ..... B24B 7/04; B24B 57/00

[58] Field of Search ..... 51/109 R, 111 R, 117, 51/118, 131, 166 R, 166 TS, 166 MH, 263

[56] References Cited

UNITED STATES PATENTS

| | | | |
|---|---|---|---|
| 1,862,379 | 6/1932 | Koestlin | 51/109 R X |
| 2,600,481 | 6/1952 | Clyde | 51/166 MH |
| 2,709,321 | 5/1955 | Inoge | 51/118 |
| 3,135,071 | 6/1964 | Godar | 51/166 R |
| 3,395,494 | 8/1968 | Sogn | 51/131 X |
| 3,541,734 | 11/1970 | Clar | 51/111 R |
| 3,609,918 | 10/1971 | Hillman | 51/117 |
| 3,848,365 | 11/1974 | Bovensiepen et al. | 51/111 R |

*Primary Examiner*—Al Lawrence Smith
*Assistant Examiner*—James G. Smith
*Attorney, Agent, or Firm*—Martin A. Farber

[57] ABSTRACT

A two wheel-lapping machine for surface-, plane-parallel-, and external plain or cylindrical- lapping, with two lapping- or working- wheels, which are mounted on one lapping wheel carrier, respectively, of which the upper lapping wheel carrier is mounted on the lower end of a main spindle and the lower lapping wheel carrier is mounted on the upper end of a main shaft, the latter being rotatably supportd in the machine bed; wherein the main spindle is formed as a piston and is axially displaceable with the piston in a cylinder, with the cylinder being rotatable in a slide, and with the slide being horizontally displaceably mounted in a frame or portal, the latter being rigidly arranged at a distance above the machine bed by means of several portal supports.

10 Claims, 6 Drawing Figures

TWO WHEEL LAPPING MACHINE

The present invention relates to a two wheel-lapping machine for surface- , plane-parallel- , and external plain or cylindrical- lapping, with two lapping- or working- wheels, which are mounted on one lapping wheel carrier, respectively, of which the upper lapping wheel carrier is mounted on the lower end of a main spindle and the lower lapping wheel carrier is mounted on the upper end of a main shaft, the latter being rotatably supported in the machine bed.

A two wheel lapping machine is known for the surface- , plane-parallel- , and plain- lapping with two lapping- or working wheels, of which the upper is arranged on a pivot arm which carries a sleeve for the mounting of the upper lapping wheel, a hydraulic for the raising and lowering of the upper lapping wheel and for the adjustment of the working pressure in the various loading stages, and a coupling for the drive of the upper lapping wheel in both directions of rotation and for the blocking and central carrying therealong of this wheel.

In the rearward part of the pivot arm, there is positioned a piston drive with pinion for the hydraulic pivoting of the arm during truing or dressing of the wheels. For the truing or dressing and for the reciprocal smoothening of the working wheels, the pivot arm can move back and forth hydraulically with continuously adjustable speed. Moreover, the pivot arm includes a device for the setting of the turning tool during the truing or dressing of the lapping wheels.

This mounting- and pivot- mechanism of the upper working wheel is of complex construction. Since the pivot arm is supported by only one column with a large lever arm, the upper construction of the machine somewhat sags. Thereby, the measurement control of the machine, the dial gage of which is disposed on the pivot arm housing, is not very exact. By the high characteristic frequency of the entire machine, the working wheels are inclined to rattle. This can be very disadvantageous in case that the machine is equipped with grinding wheels.

With the known machines the main bearing of the lower lapping- or working- wheel is formed in the machine bed as a wire race ball bearing, combined with a single row angular contact ball bearing. A wire race ball bearing is indeed a bargin, however the manufacture of its seat in the housing and in the lower lapping wheel carrier is expensive through precise working, likewise as is the assembling. It requires continuous servicing.

The cooling for the lapping- or working- wheels is arranged in the known machines between the main bearing and the protective lubricant. Thereby it is possible with an abatement of the sealing, for grease and oil to mix with the cooling water. Further, the assembling of the cooling apparatus is expensive and a non-objectionable operation can not be maintained or controlled.

The sleeve for the mounting of the upper lapping wheel comprises a cylinder in which the main spindle is rotatably and drivably mounted. The hydraulics for the raising and lowering of the upper working wheel is formed as a piston, which is axially displaceably (however not rotatably) mounted in the pivot arm housing and which is driven by means of a pressure medium, the latter being fed and removed by means of connections on the pivot arm housing. Since the piston is rigidly connected with the cylinder, the cylinder is not permitted to execute a rotatable movement. For this purpose, on the lower end of the cylinder there is provided a steadyrest on which a rod is secured which is guided in the pivot arm housing. Since the cylinder is not allowed to rotate, the drive wheel for the rotatable movement of the main spindle must be specially mounted.

In order to be able to advance or feed a load table closely or tightly on the lower lapping wheel, the outer stud ring of the lapping gear drive for the work holding wheels must be able to be lowered. For this, with the known machines, it is mounted on two lifting spindles at two positions diametrically opposite to each other, the spindles being adjustable in height by means of two spindle nuts, two worm drives and a motor. The two worm drives represent a large technical and commercial expense. They undergo wear and tear and require servicing. Furthermore, they are installable and dismountable only with a large expenditure of time and work, since being provided on difficultly accessible positions in the machine bed.

Accordingly, it is an object of the present invention to provide a lapping machine of the introductory mentioned type, such that, by elimination of the above-mentioned disadvantages and defects of the known machines, the rigidity of the machine is increased, the operating- and installation- expenses are reduced and the mounting, lubrication and cooling of the lower lapping wheel carrier are operatively reliably separated from each other in the machine bed. Simultaneously, the rod guide with steadyrest, as security against rotation of the cylinder, and the particular mounting of the drive wheel for the rotating movement of the main spindle on the pivot arm housing can be discarded. Finally, the two worm drives for the raising and lowering of the outer stud ring should be avoided.

This object is solved in accordance with another object of the present invention in that the main spindle is formed as a piston and is axially displaceable with the piston in a cylinder, with the cylinder being rotatable in a slide, and with the slide being horizontally displaceably mounted in a frame or portal, the latter being rigidly arranged at a distance above the machine bed by means of several portal supports.

The technical advance achieved by the present invention is based on the following advantages. By the arrangement in accordance with the invention a pivot arm and therewith associated complex mounting- and pivot- mechanism of the upper working wheel is avoided. By means of the formation as a portal machine, there arises a compact manner of construction with smaller requirements of mounting or bearing surfaces and higher production efficiencies. Since a portal supported by means of four columns or posts with small or insignificant lever arm, contrary to a pivot arm supported by only one column with large lever arm, has the result of considerably smaller deflection or elasticity, there results an essentially rigid machine design. In this manner, a more precise measurement control is made possible. Further, the entire machine maintains a lower characteristic or resonance frequency, whereby the working wheels are less inclined to rattle.

By means of the absence of the pivot arm, the steadyrest with rods and rod guide is unnecessary, likewise is the additional bearing or mounting of the toothed or gear belt pulley for the rotable movement of the main spindle. An important advantage resides in the smaller manner of construction of the hydraulic piston, which by means of the direct arrangement on the main spindle, is smaller in diameter. In this manner there arises a smaller piston surface and thus a smaller or insignificant deviation of the loading force from the nominal value, which develops from viscosity changes due to variations in the temperature of the pressure medium.

Further important features of the invention, although not limited thereto, are set forth in the following.

A simpler construction, compared to the troublesome pivot mounting of the upper lapping carrier wheel by means of the pivot arm, is achieved in accordance with the present invention in the manner that the slide in the portal is displaceably mounted on a linear rod guide and is driven by means of a hydraulic piston and cylinder.

According to a further important feature of the invention, the main mounting or bearing of the lower lapping wheel carrier is formed as an axially grooved ball bearing in connection with a conical roller bearing assembly. In this manner the manufacture of the housing and the seat for the main shaft of the lower lapping wheel carrier is substantially simplified. It results in a friction-free running operation, and no servicing is required.

In accordance with the invention, in order to achieve a complete separation of the bearing, lubrication and cooling of the lower lapping wheel carrier, the main shaft is formed as the feed conduit for the cooling medium and the connections for feeding and removal of the cooling medium are arranged on an extension of the main shaft. The thereby achieved separation of the bearing, lubricant and cooling is service-wise favorable and offers protection against consequential damage. The cooling no longer has contact with bearing or mounting elements and their protective lubricant. The assembling is simpler and likewise finally still possible. The operation of the cooling is easily controllable. The lower main bearing, including the cooling and center drive units, is completely dismountable.

According to a further feature of important significance, the connections for the pressure medium for the raising and lowering of the upper lapping wheel carrier and for the adjustment of the working pressure in different loading stages, are arranged on the slide and are connected with the cylinder spaces on both sides of the piston via a rotary transmission each.

When two lifting spindles are provided for raising and lowering the outer stud ring of an epicyclic gear drive for the work holding wheels, which lifting spindles are driven by two spindle nuts, it is advantageous to drive one spindle nut over a chain and the second spindle nut by the first by means of a toothed or gear belt, which by means of two lateral deflection wheels is held open and tight.

With the above and other objects and advantages in view the present invention will become more clearly understood from the following detailed description taken in connection with the accompanying drawings, of which:

Figure 1:
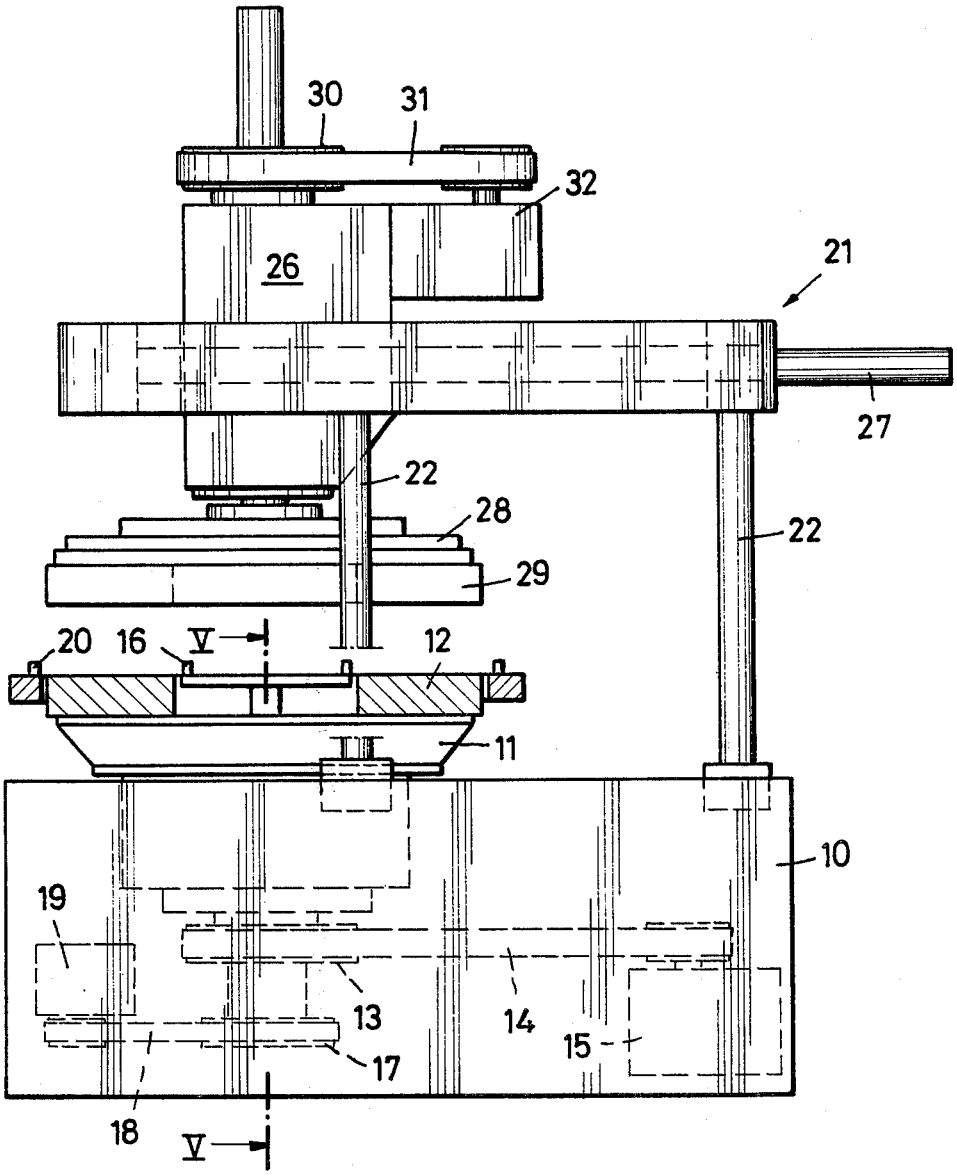
FIG. 1 is a side elevational view partly in section of a two wheel lapping machine in accordance with the present invention.
Figure 2:
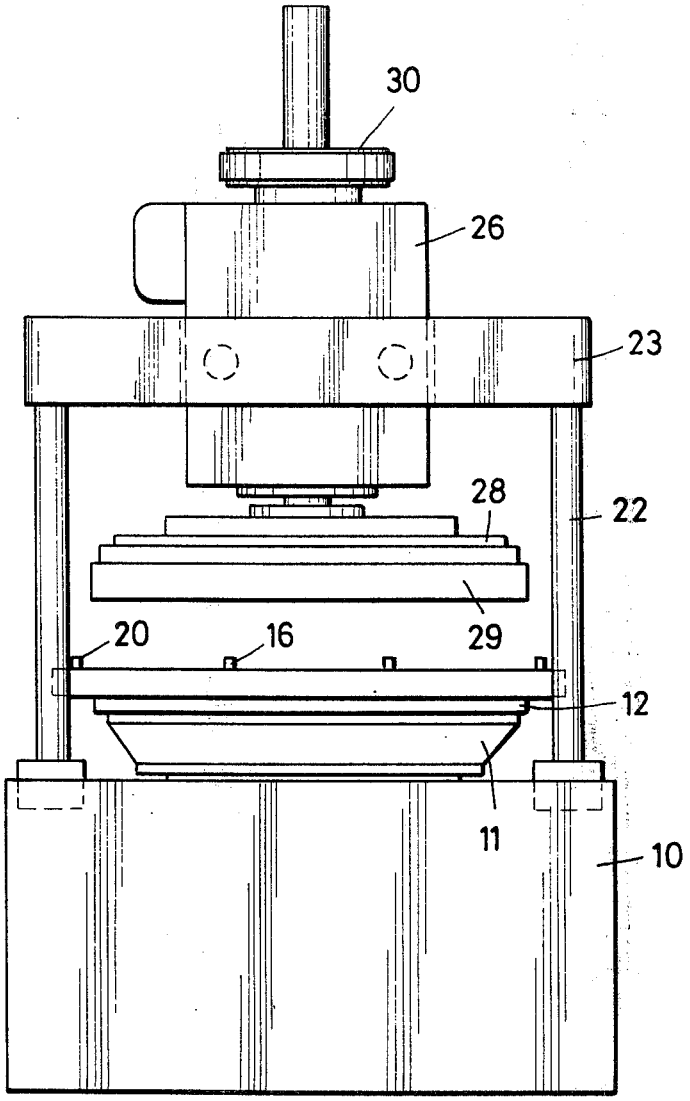
FIG. 2 is a front view of the machine of FIG. 1.
Figure 3:
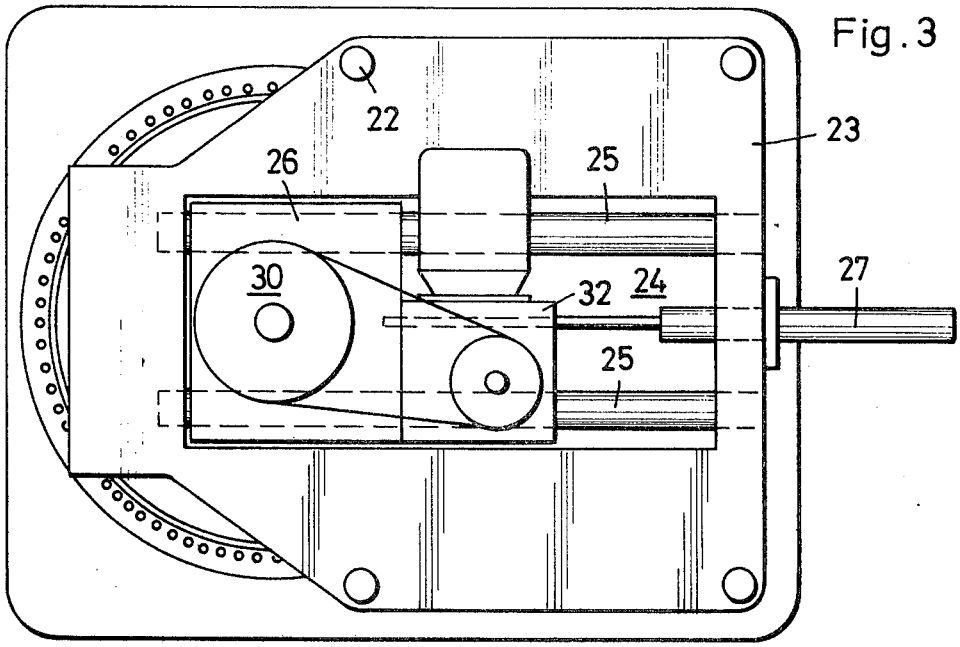
FIG. 3 is a top plan view of the machine.

Referring now to the drawings and more particularly to FIGS. 1–4, the double wheel lapping machine according to the present invention comprises a machine bed 10 in which there is rotatably mounted a lower lapping wheel carrier 11 with an annular shaped lapping wheel 12. The lapping wheel carrier 11 is driven by means of a toothed or gear belt pulley 13 and a cooperating toothed or gear belt 14 by a motor 15. An inner stud ring 16, constituting a workpiece drive, is rotatably mounted in the center of the lapping wheel 12, and is driven by means of a toothed or gear belt pulley 17 and a cooperating toothed or gear belt 18 by a motor 19. An outer stud ring 20 of a lapping epicyclic gear drive for the workpiece drive is liftably and lowerably mounted around the outer circumferential edge of the lapping wheel 12.

A portal or upper frame 21 is rigidly connected with the machine bed 10, the portal comprising four rigidly arranged supports, for example, columns or posts 22 and a crosspiece 23. The portal 21 together with the machine bed 10 forms a rigid frame closing on itself, with which very large forces can be assumed and which has a low characteristic frequency. The crosspiece 23 has an opening 24 in which two guide rods 25 are arranged, on which a slide block 26 is horizontally displaceably mounted. The slide 26 can be displaced on the guide rods 25, constituting a linear rod guide, by means of a hydraulic cylinder-piston assembly 27. An upper lapping wheel carrier 28 with a likewise annularly shaped lapping wheel 29 is rotatably mounted in the slide 26. The lapping wheel carrier 28 is driven by means of a toothed or gear belt pulley 30 and a cooperating toothed or gear belt 31 by a worm wheel drive motor 32.

Figure 4:
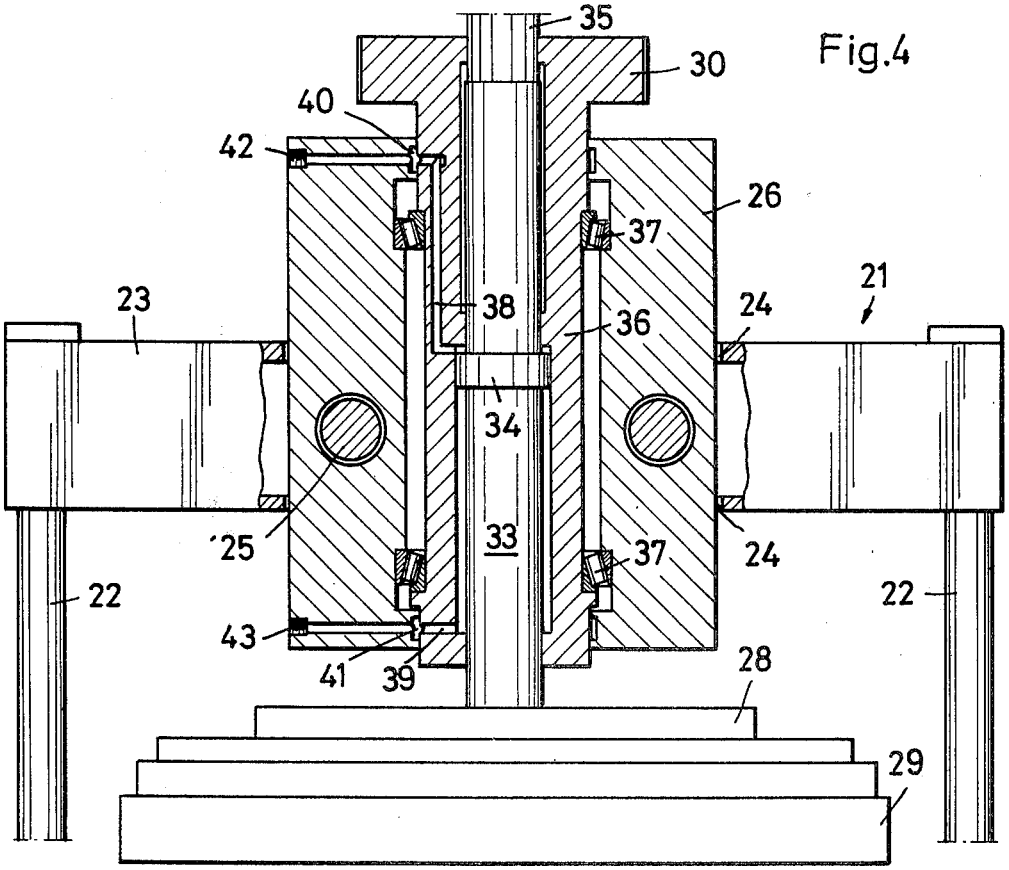
FIG. 4 is an enlarged front view partly in section of the upper part of the machine showing the portal and slide.

As particularly evident from FIG. 4, the upper lapping wheel carrier 28 is located on the lower end of a main spindle 33, the latter being formed as a piston 34 in its middle part and as a multi-spline shaft 35 at its upper end.

The main spindle 33 is axially displaceably mounted with its piston 34 in a cylinder 36, which in turn is rotatably mounted in the slide 26 by means of a conical or tapered roller bearing assembly 37. The piston 34 slides in the cylinder 36, defining cylinder chambers on both sides of the piston in the cylinder 36, the two ends of which are formed with respective openings, constituting a pressure medium conduit 38 and 39, respectively, which connect in communication with two supply connections (or threaded openings) 42 and 43 for a pressure medium via a rotary transmission 40 and 41, respectively, in the slide 26.

For the raising and lowering of the upper lapping wheel carrier 28 and for the adjustment of the working pressure in the different loading stages, the lower cylinder chamber or the upper cylinder chamber part of the cylinder 36 is admitted with the pressure medium. Consequently the main spindle 33 with its multi-spline shaft 35 is displaced in a multi-spline bore in the pulley 30. The pulley 30 can be formed integrally in one piece with the cylinder 36.

By the formation of the center part of the main spindle 33 as a hydraulic piston, the latter can be held substantially smaller in diameter, than if the cylinder were formed as a piston. In addition to the advantage of a smaller manner of construction per se, the advantage is achieved that the loading force deviates little from the intended nominal value with viscosity changes of the pressure medium as a result of temperature variations.

Figure 5:
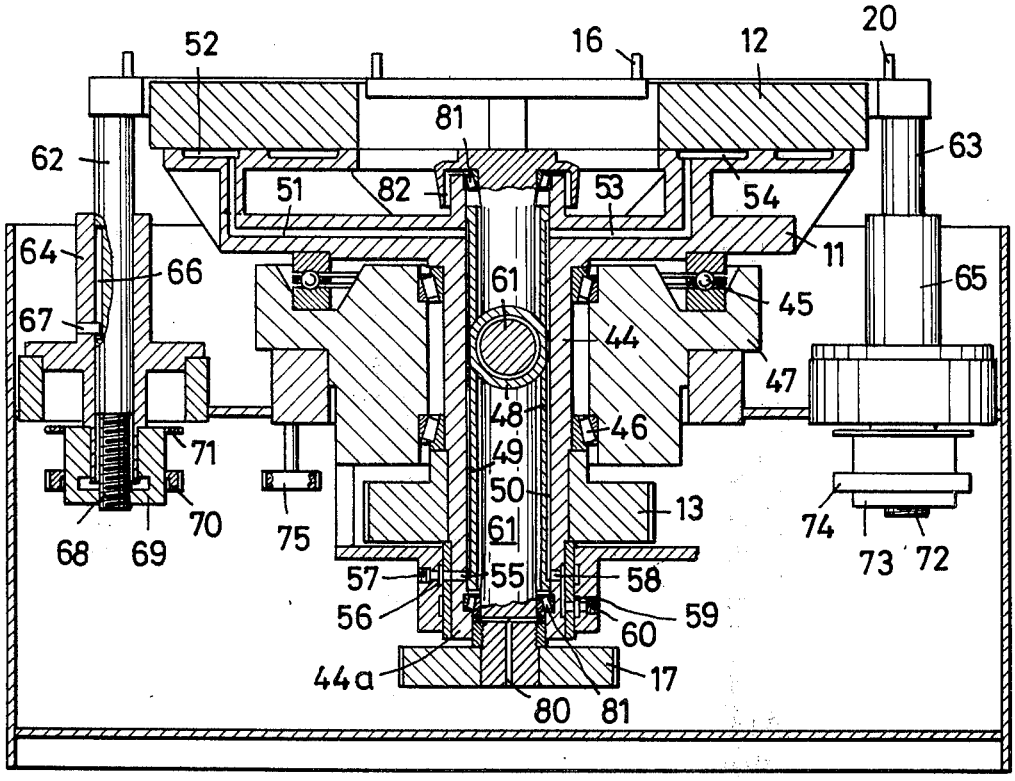
FIG. 5 is a vertical longitudinal, enlarged sectional view of the machine bed taken along the lines V — V of FIG. 1.

As shown in FIG. 5, the lower lapping wheel carrier 11 is arranged on the upper end of a main shaft 44 and is rotatably mounted on an axially grooved ball bearing 45, which together with a conical or tapered roller bearing assembly 46 by which the main shaft 44 is rotatably mounted in a bearing housing 47, form the main bearing or mounting of the lapping wheel carrier 11. In this manner there is brought about a simple and thus less expensive production of the seat for the complete $\phi$ bearing in the housing and on the shaft, respectively. The revolving parts have a friction-free (i.e., low friction) operation and are service-free.

The main shaft 44 is constructed hollow and is lined inside with a bushing 48, which is flattened on two opposite sides with respect to each other, so that two channels 49 and 50 are formed. The channel 49 is connected via a conduit 51 with an outer annular trough 52, in the lapping wheel carrier 11, and the channel 50 is connected via a conduit 53 with an inner annular trough 54 in the lapping wheel carrier 11. On an extension 44*a* of the main shaft 44 which projects beyond the toothed or gear belt pulley 13, the channel 49 passes in communication via a bore 55 and a rotary transmission 56 into a connection 57 for the feeding of a cooling medium for the lapping wheel 12, and the channel 50 passes in communication via a conduit 58 and a rotary transmission 59 into a connection 60 for the exiting of the cooling medium for the lapping wheel 12. In order to cool the lapping wheel 12, a cooling medium is introduced through the connection 57 and is again removed through the connection 60. By means of the arrangement of the feeding and exiting of the cooling medium of the extended main shaft 44, to the contrary of the known machines in which the cooling is arranged between the main bearing and the protective lubrication means such that with defective sealing, grease and oil is able to mix with the cooling medium, by the arrangement of the present invention there is prevented a contacting of the cooling medium with the bearings 45, 46, as well as with the protective lubricant, which is fed centrally to the shaft 61 through bore 80. Whereas with the known machines, the assembly of the cooling apparatus is expensive and its function can not be controlled, the cooling apparatus according to the present invention is arranged and constructed such that it can be assembled simply also as a supplement and its operation is easily controllable.

A drive shaft 61 for the inner stud ring 16 passes through the bushing 48. The shaft 61 is rotatably mounted by means of a conical roller bearing set 81 longitudinally in the hollow main shaft 44, and is led out of the main shaft 44 at its end opposite the stud ring 16 and provided with a toothed or gear belt pulley 17. (FIG. 5 also shows a horizontal cross-sectional view of the shaft 61 in the bushing 48 for clarity). The grease protective lubricant goes through the bore 80, the conical roller bearing assembly and again enters in the labyrinth 82, constituting a grease lubricating path. It thus avoids penetration of lapping abrasive or the like.

Figure 6:
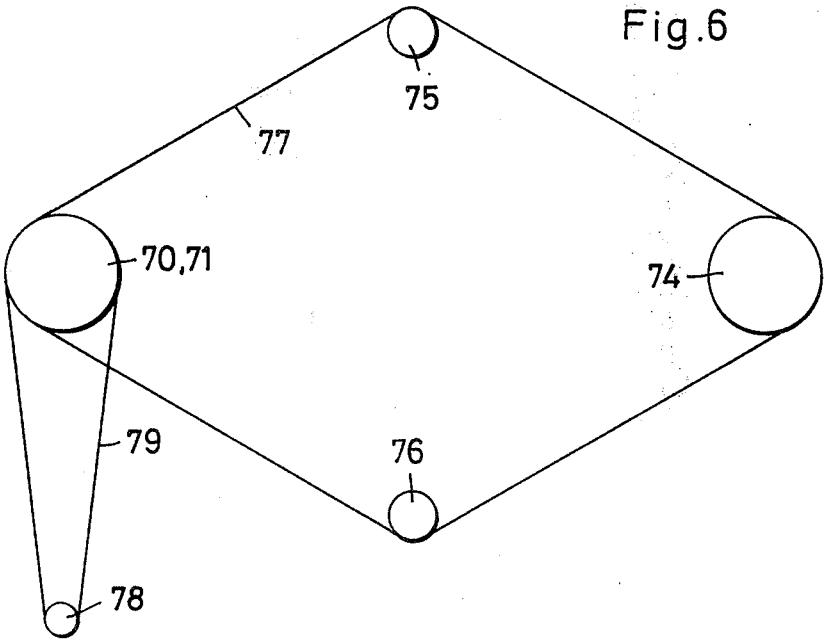
FIG. 6 is a schematic top plan view of the drive for the outer stud ring.

The outer stud ring 20 rests on two main spindles 62 and 63 which are opposite one another. The spindles are displaceably guided sliding in a vertical direction in a spindle housing 64 and 65, respectively, and are prevented from rotatable movement by means of a keyway groove 66 and a cooperating key slide block 67, in the spindle 62 and in the housing 64, respectively. The grooves and the slide block, respectively, cooperatively limit the stroke of the spindle 62. The lower end of the lifting spindle 62 has a thread 68 thereon, on which a spindle nut 69 is operatively cooperatively screwed, the latter carrying a toothed or gear belt pulley 70 and a sprocket wheel 71. The spindle nut 69 is rotatably mounted on the spindle housing 64. Also, the lifting spindle 63 has a thread 72 on which a spindle nut 73 is operatively cooperatively screwed, which however only carries a toothed or gear belt pulley 74. Two lateral deflection or compensation wheels 75 and 76 which are positioned opposite each other are rotatably mounted on the bearing housing 47 of the lower lapping wheel carrier 11 at the height of the toothed or gear belt pulleys 70 and 74, as may be seen in FIG. 6. A tooth or gear belt 77 is placed around the pulleys 70 and 74 and the deflection wheels 75 and 76, which belt synchronously operates the spindle nuts 69 and 73, such that the outer stud ring 20 is uniformly raised. A chain 79 is positioned about the sprocket wheel 71 and a sprocket wheel 78 of a further motor (not illustrated), which drives the spindle nut 69. The deflection wheels 75 and 76 hold the belt 77 apart, so that it does not strip the bearing housing 47. They simultaneously serve for the tightening of the belt 77.

Contrary to the known setting devices for the outer stud ring with two worm drives, in accordance with the present invention there results a simpler technical manufacturing construction. The lifting spindle permits for assembling and disassembling from above in the machine bed, easy installation and removal. Costly servicing is avoided.

The machine can also be used as a grinding- and honing-machine; then fine or close grained grinding wheels, polishing -cloths or -felts are used as the working wheels.

While I have disclosed at least one embodiment of the present invention, it is to be understood that same is given by example only and not in a limiting sense.

I claim:

1. A two wheel lapping machine for surface-, plane-parallel-, and external plain- lapping, comprising a machine bed including a main shaft rotatably mounted therein, said main shaft having an upper end, an upper frame including a crosspiece and a plurality of frame support means connected to said crosspiece and to said machine bed for rigidly supporting said crosspiece in a position spaced above said machine bed, a slide horizontally displaceably mounted in said crosspiece, a cylinder rotatably mounted in said slide, a main sindle formed as a piston and mounted in said cylinder axially displaceable and non-rotatable relative to said cylinder, said main spindle having a lower end, an upper lapping wheel carrier mounted on said lower end of said main spindle, a lower lapping wheel carrier on said upper end of said main shaft, and two lapping wheels mounted on said upper and lower lapping wheel carriers, respectively.

2. The two wheel lapping machine, as set forth in claim 1, further comprising linear rod guide means for displaceably mounting said slide in said crosspiece, and means for displacing said slide.

3. The two wheel lapping machine, as set forth in claim 1, further comprising main bearing means for rotatably mounting said lower lapping wheel carrier and said main shaft, respectively, on said machine bed constitutes an axially grooved ball bearing and a set comprising two conical roller bearings, respectively.

4. The two wheel lapping machine, as set forth in claim 3, wherein said machine bed includes a bearing housing, said upper lapping wheel carrier is formed integrally with said main shaft, said axially grooved ball bearing is disposed operatively between said upper lapping wheel carrier and said bearing housing, and said conical roller bearing set is operatively disposed between said main shaft and said bearing housing.

5. A two wheel lapping machine for surface-, plane-parallel-, and external plain- lapping, comprising a machine bed including a main shaft rotatably mounted therein, said main shaft having an upper end, an upper frame, a plurality of frame support means for rigidly supporting said upper frame in a position spaced above said machine bed, a slide horizontally displaceably mounted in said upper frame, a cylinder rotatably mounted in said slide, a main spindle formed as a piston and mounted axially displaceable in said cylinder, said main spindle having a lower end, an upper lapping wheel carrier mounted on said lower end of said main spindle, a lower lapping wheel carrier on said upper end of said main shaft, two lapping wheels mounted on said upper and lower lapping wheel carriers, respectively, said main shaft is formed as a feed conduit for a cooling medium, said main shaft has an extension, and connection means disposed on said extension of said main shaft for feeding and removing the cooling medium.

6. The two wheel lapping machine, as set forth in claim 1, further comprising two connection means for a pressure medium for raising and lowering, respectively, said upper lapping wheel carrier, said two connection means are on said slide, and said piston is operatively mounted in said cylinder defining two cylinder chambers on both sides of said piston, respectively, and two rotary transmission means for operatively connecting each of said two connection means with said two cylinder chambers, respectively.

7. The two wheel lapping machine, as set forth in claim 1, further comprising a lapping gear drive means for work holding wheels including an outer stud ring, the latter being coaxially disposed around a lower of said two lapping wheels, two lifting spindle means for raising and lowering said outer stud ring, two spindle nut means operatively connected to said two lifting spindle means, respectively for driving said two lifting spindle means, chain means for driving one of said two spindle nut means, belt means operatively connected with said two spindle nut means for driving the other of said two spindle nut means by said one of said two spindle nut means, and two spaced-apart deflection wheel means for holding said belt means therearound open and tightened.

8. A two wheel lapping machine for surface-, plane-parallel-, and external plain-lapping, comprising a machine bed including a main shaft rotatably mounted therein, said main shaft having an upper end, an upper frame, a plurality of frame support means for rigidly supporting said upper frame in a position spaced above machine bed, a slide horizontally displaceably mounted in said upper frame, a cylinder rotatably mounted in said slide, a main spindle formed as a piston and mounted axially displaceable in said cylinder, said main spindle having a lower end, an upper lapping wheel carrier mounted on said lower end of said main spindle, a lower lapping wheel carrier on said upper end of said main shaft, two lapping wheels mounted on said upper and lower lapping wheel carriers, respectively, one of said two lapping wheels constitutes a lower lapping wheel formed as an annular ring mounted on said lower lapping wheel carrier, an inner stud ring coaxially inside of said lower lapping wheel, a drive shaft connected to said inner stud ring and mounted in said main shaft and having one end leading out of said main shaft, means for rotatably mounting said drive shaft in said main shaft and constituting conical roller bearings, said one end of said drive shaft being formed with a central bore, constituting a portion of a grease lubricating path, communicating with said conical roller bearings, and said main shaft and said drive shaft cooperatively forming a labyrinth constituting another portion of said grease lubricating path communicating with said conical roller bearings.

9. The two wheel lapping machine, as set forth in claim 1, further comprising motor means mounted in said slide for rotating said cylinder, whereby said main spindle is rotated jointly therewith to turn said upper lapping wheel carrier.

10. The two wheel lapping machine as set forth in claim 9, wherein said cylinder is formed with a multi-spline bore, and said main spindle includes a multi-spline shaft extending through said multi-spline bore.

* * * * *